US005105778A

United States Patent [19]

Svensson

[11] Patent Number: 5,105,778

[45] Date of Patent: Apr. 21, 1992

[54] ARRANGEMENT IN AN I.C. ENGINE

[75] Inventor: Mats R. Svensson, Jönköping, Sweden

[73] Assignee: Aktiebolaget Electrolux, Stockholm, Sweden

[21] Appl. No.: 643,535

[22] Filed: Jan. 18, 1991

[51] Int. Cl.[5] ..... F02B 77/00

[52] U.S. Cl. ..... 123/195 C; 123/198 E; 123/41.7

[58] Field of Search ..... 123/41.7, 185 B, 195 C, 123/195 R, 198 E

[56] References Cited

U.S. PATENT DOCUMENTS 4,548,169 10/1985 Nagashima ..... 123/198 E
4,765,282 8/1988 Nagashima ..... 123/198 E
4,770,130 9/1988 Nagashima ..... 123/41.7
4,783,207 11/1988 Nagashima et al. ..... 123/198 E
4,788,951 12/1988 Nagashima ..... 123/198 E
4,793,303 12/1988 Nagashima ..... 123/198 E
4,913,112 4/1990 Iida ..... 123/198 E
5,018,492 5/1991 Wolf et al. ..... 123/198 E

*Primary Examiner*—E. Rollins Cross
*Assistant Examiner*—Weilun Lo
*Attorney, Agent, or Firm*—Pearne, Gordon, McCoy & Granger

[57] ABSTRACT

A two-stroke engine with crankcase compression has a hose (17) with an inlet duct (18) to the engine block of a chain saw with a partition wall (15) between an engine and a carburetor room (14). The hose runs from the carburetor through the wall to the engine block and is provided with a flange (20) squeezed between the wall and the carburetor which attached by set screws to the wall. In the same hose (17), a hollow passage (19) runs from the crankcase to the fuel pump of the carburetor.

3 Claims, 1 Drawing Sheet

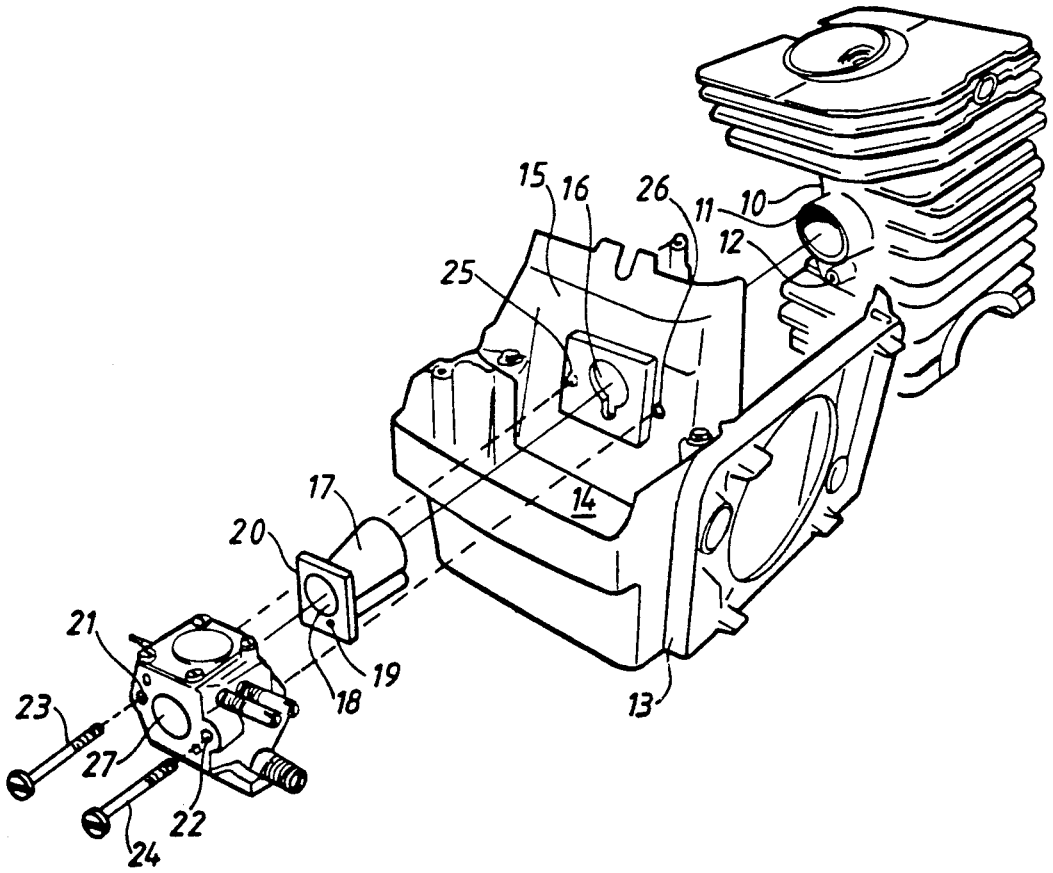
15
16
26
11
10
12
25
17
20
14
21
19
18
13
23
27
22
24

ARRANGEMENT IN AN I.C. ENGINE

BACKGROUND OF THE INVENTION

The present invention relates to an arrangement of an inlet duct on a two-stroke engine with crankcase compression.

With regard to a built-in two-stroke engine in, for example, a chain saw, it is appropriate to arrange a special carburetor room, where an air filter, a carburetor, controls and ducts are located. In this connection there is an umber of possibilities to fasten the parts on the walls of the carburetor room, for example, to the wall towards the cylinder or to the bottom of the carburetor room. It is known to manufacture an inlet duct to the engine as a hose fastened on nipples, one on the engine and one on the carburetor. A membrane carburetor is normally not provided with a nipple, which makes it less suitable for the fitting of a hose to a partition wall. It is, however, possible to fit the carburetor to the partition wall if the inlet duct is shaped in a special way.

SUMMARY OF THE INVENTION

The problem being the basis of the invention is to combine the inlet duct with fastening devices in the partition wall and in the carburetor, so that a straight connection with tightening against the wall as well as against the carburetor is obtained with only one single element. The solution of the problem is here presented in the form of a hose piece with a flange, suitable to be put on a nipple in the engine block and to be squeezed against contact surfaces on the carburetor as well as on the partition wall. Such as embodiment results in a simple assembly operation which may well be carried out in an automatic manufacturing process. The object of the invention is, for the rest, defined in claim 1 below.

An embodiment according to the invention will be described in the following with reference to the attached drawing showing an exploded view of an engine block with a crankcase and a carburetor as well as an inlet duct.

DETAILED DESCRIPTION OF THE PREFERRED EMBODIMENT

The engine block consists of a cylinder part 10 of an air-cooled two-stroke engine with a formed nipple 11 on the side of the inlet port. Below it, there is a smaller nipple 12 having connection with the crankcase, the bottom part of which is formed in a casing part 13 of a chain saw. That casing part also includes a separate space 14 forming a carburetor room. The latter is separated from the engine by a wall 15 having an opening 16 which is concentric with the nipple 11. The wall prevents heat radiation from the cylinder to the carburetor that could be too hot when the engine has stopped. The wall has here a secondary function as an attachment for an inlet hose 17 conducting gas from the carburetor to the engine and impulses from the crankcase to the carburetor. The gas is conducted in a duct 18, the end of which can be put on the nipple 11, and the pressure impulses in a hollow passage 19, the end of which can be put on the nipple 12. The end turned to the carburetor has a flange 20 which is in contact with the wall 15 turned to the carburetor after introducing the hose into the opening 16. The carburetor has a flat contact surface against he flange and a couple of holes 21, 22 for set screws 23, 24 that are then screwed into threaded holes 25, 26 in the wall 15. The gas duct 27 of the carburetor is, in this way, connected to the duct 18 of the hose and the fuel pump of the carburetor, which operates on the pressure impulses connected to the hollow passage 19.

The described embodiment shall be regarded as an example of how the invention can be realized. Of course, some parts may be moved, completed, replaced or made in a different way without departing from the scope of the invention.

I claim:

1. Arrangement in a two-stroke i.c. engine with crankcase compression and an intake port in a cylinder part of the engine, as well as an inlet hose, connected to the port and to a carburetor of the engine, wherein a partition wall between the carburetor and the cylinder part defines an opening in which the hose is inserted, said hose having a flange at an end which faces the carburetor, said flange, on the inside of a screw joint, constituting a gasket between the carburetor and the partition wall, said inlet hose contains a hollow passage, located besides a gas duct, forming a connection between a crankcase of the engine and a fuel pump of the carburetor.

2. Arrangement according to claim 1, wherein the partition wall and the bottom part (13) of the crankcase are made in one piece.

3. Arrangement according to claim 2, wherein the wall separates the carburetor room (14) from the engine.

* * * * *